US006050574A

United States Patent [19]

Olson et al.

[11] Patent Number: 6,050,574

[45] **Date of Patent: *Apr. 18, 2000**

[54] ADJUSTABLE FIT IN-LINE SKATE

[75] Inventors: Todd Jack Olson, Chanhassen; Thomas Lee Spaulding, St. Louis Park; Alan Eugene Doop, Delano, all of Minn.

[73] Assignee: Rollerblade, Inc., Minneapolis, Minn.

[ * ] Notice: This patent is subject to a terminal disclaimer.

[21] Appl. No.: 09/264,548

[22] Filed: Mar. 8, 1999

Related U.S. Application Data

[63] Continuation of application No. 08/908,863, Aug. 8, 1997, Pat. No. 5,913,526, which is a continuation of application No. 08/477,181, Jun. 7, 1995, Pat. No. 5,678,833.

[51] Int. Cl.[7] ..... A63C 17/00

[52] U.S. Cl. ..... 280/11.22; 280/11.26; 280/11.3; 36/97; 36/115

[58] Field of Search ..... 280/11.22, 11.26, 280/11.3, 841, 11.19, 11.27, 11.28; 36/97, 115, 102

[56] References Cited

U.S. PATENT DOCUMENTS

| | | |
|---|---|---|
| D. 300,049 | 2/1989 | Klammer et al. . |
| D. 326,700 | 6/1992 | Brown et al. . |
| D. 333,171 | 2/1993 | Gertler . |
| D. 337,805 | 7/1993 | Rosso et al. . |
| D. 341,863 | 11/1993 | Cavasin . |
| D. 342,113 | 12/1993 | Cavasin . |
| D. 344,316 | 2/1994 | Gertler . |
| D. 345,405 | 3/1994 | Cavasin . |
| D. 346,633 | 5/1994 | Conte . |
| D. 347,237 | 5/1994 | Robjent et al. . |
| D. 353,429 | 12/1994 | Gay et al. . |
| 1,633,418 | 6/1927 | La Marca . |
| 2,523,449 | 9/1950 | Rosenweig . |

(List continued on next page.)

FOREIGN PATENT DOCUMENTS

| | | |
|---|---|---|
| 0215744 | 3/1987 | European Pat. Off. . |
| 0356398 | 8/1989 | European Pat. Off. . |
| 443293A1 | 2/1990 | European Pat. Off. . |
| 551704 | 7/1993 | European Pat. Off. . |
| 610652 | 8/1994 | European Pat. Off. . |
| 1266620 | 6/1961 | France . |
| 2448362 | 9/1980 | France . |
| 2515053 | 4/1983 | France . |
| 2520242 | 7/1983 | France . |
| 2561115 | 9/1985 | France . |
| 2614547 | 11/1988 | France . |
| 597644 | 1/1933 | Germany . |
| 2749887 | 8/1978 | Germany . |
| 2800626 | 7/1979 | Germany . |
| 3212933 | 10/1983 | Germany . |
| 3835035 | 7/1989 | Germany . |
| 7311611 | 8/1973 | Netherlands . |
| 8903154 | 12/1989 | Netherlands . |
| 9000384 | 2/1990 | Netherlands . |
| 674292 | 6/1952 | United Kingdom . |
| 92/18023 | 10/1992 | WIPO . |
| 9414350 | 7/1994 | WIPO . |

OTHER PUBLICATIONS

Promotional literature of Roces, Inc. showing Roadskates® in–line skate.

PCT International Publication No. WO92/09340 published Jun. 11, 1992.

PCT International Publication No. WO80/02789 published Dec. 24, 1980.

German Publication GMA–HEFT 48VOM, dated Nov. 27, 1980.

*Primary Examiner*—J. J. Swann
*Assistant Examiner*—David R. Dunn
*Attorney, Agent, or Firm*—Merchant & Gould P.C.

[57] ABSTRACT

An adjustable fit in-line skate is disclosed having a rigid frame carrying a plurality of skate wheels. A boot is secured to the frame with the boot having a toe portion and a heel portion. The heel portion has a sole plate which is carried over the length of the frame. The toe portion receives the sole plate and is slidably attached to the heel portion.

8 Claims, 8 Drawing Sheets

U.S. PATENT DOCUMENTS

| | | |
|---|---|---|
| 2,572,050 | 10/1951 | Ornstein . |
| 3,229,989 | 1/1966 | Papangulis . |
| 3,389,481 | 6/1968 | England . |
| 3,431,658 | 3/1969 | Finn . |
| 3,541,708 | 11/1970 | Rosen . |
| 3,645,017 | 2/1972 | Hickmann . |
| 3,686,777 | 8/1972 | Rosen . |
| 3,858,337 | 1/1975 | Vogel . |
| 3,895,452 | 7/1975 | Hanson et al. . |
| 3,922,800 | 12/1975 | Miller et al. . |
| 3,963,252 | 6/1976 | Carlson . |
| 3,977,098 | 8/1976 | Chalmers . |
| 4,058,324 | 11/1977 | Dallaire . |
| 4,060,918 | 12/1977 | Mandel . |
| 4,083,128 | 4/1978 | Rossman . |
| 4,120,103 | 10/1978 | Colby . |
| 4,126,323 | 11/1978 | Scherz . |
| 4,299,039 | 11/1981 | Hanson . |
| 4,334,690 | 6/1982 | Klamer et al. . |
| 4,379,564 | 4/1983 | Welker . |
| 4,523,392 | 6/1985 | Gabrielli . |
| 4,708,352 | 11/1987 | Vullierme . |
| 4,747,221 | 5/1988 | Hayes . |
| 4,773,886 | 9/1988 | Teeter et al. . |
| 4,959,914 | 10/1990 | Hilgarth . |
| 5,046,746 | 9/1991 | Gierveld . |
| 5,092,614 | 3/1992 | Malewicz . |
| 5,184,834 | 2/1993 | Yu . |
| 5,397,141 | 3/1995 | Hoshizaki et al. . |
| 5,475,936 | 12/1995 | Cavasin . |
| 5,484,149 | 1/1996 | Lee . |
| 5,566,475 | 10/1996 | Donnadieu . |

ADJUSTABLE FIT IN-LINE SKATE

This application is a Continuation of application Ser. No. 08/908,863 (now issued U.S. Pat. No. 5,913,526) filed Aug. 8, 1997, which is a Continuation of application Ser. No. 08/477,181, filed Jun. 7, 1995 (now issued U.S. Pat. No. 5,678,833), which applications are incorporated herein by reference.

I. BACKGROUND OF THE INVENTION

1. Field of the Invention

This invention pertains to skates such as in-line skates and the like. More particularly, this invention pertains to such a skate which may accommodate a variety of shoe sizes.

2. Description of the Prior Art

In recent years, the sport of in-line skating has enjoyed a tremendous growth in popularity. In addition to being enjoyable exercise for adults, children have participated in in-line skating.

High quality in-line skates can be expensive. The expense is particularly frustrating for parents of young children. As the children grow, their foot sizes expand necessitating frequent replacement of footwear of any type including recreational footwear such as in-line skates.

In the past, in-line skate manufacturers have accommodated growth in foot size by having an oversized molded boot containing a replaceable liner. Liners of various wall thicknesses could be provided such that the liners could be replaced to accommodate different foot sizes. Alternatively, various techniques have been provided for permitting the boot of the skate to adjust to accommodate growth in foot size. However, such techniques have commonly been lacking in providing for a construction which is secure after adjustment and without impairing performance of the skate.

II. SUMMARY OF THE INVENTION

According to a preferred embodiment of the present invention, an adjustable fit in-line skate is provided having a rigid frame with a plurality of in-line skate wheels secured to the frame. A boot is secured to the frame with the boot having a toe portion and a heel portion. The heel portion includes a sole and the heel portion is fixed to the frame. The toe portion has a base and is fastened to the heel portion by means which releasably secure each of the base and the sole to at least a portion of the frame. The toe portion is slidable relative to the heel portion along a line of travel which is generally parallel to the longitudinal dimension of the skate. The toe portion may be fixed at any one of a plurality of fixed positions along the line of travel.

III. BRIEF DESCRIPTION OF THE DRAWINGS

IV. DESCRIPTION OF THE PREFERRED EMBODIMENT

Figure 2:
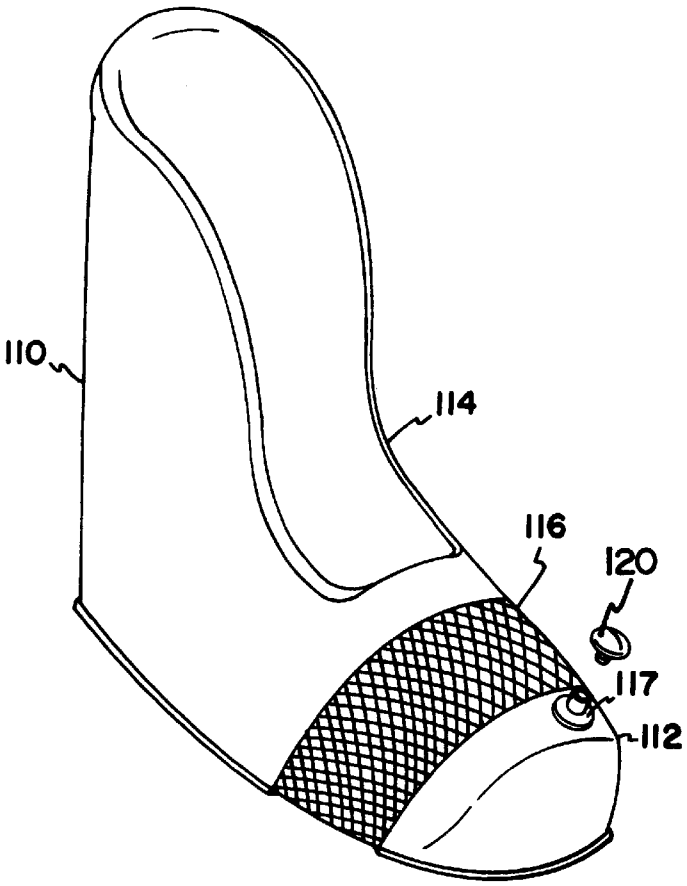
FIG. 2 is an exploded perspective view of a liner for use with the skate of FIG. 1.
Figure 1:
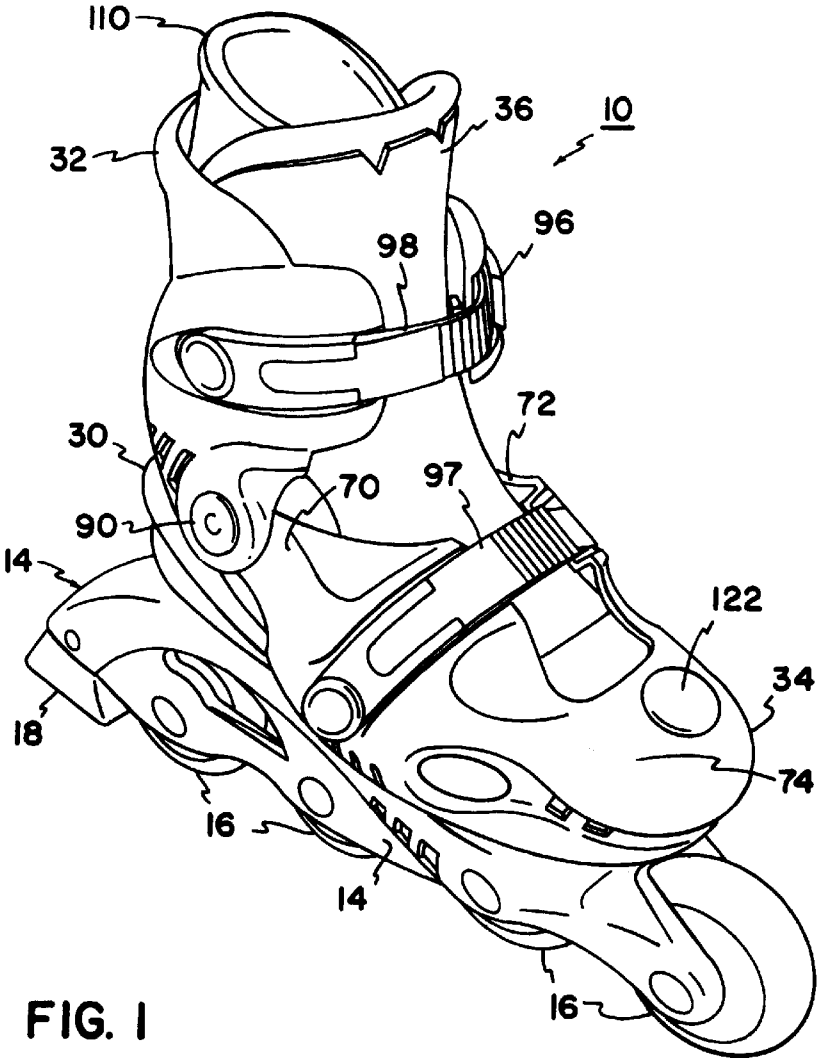
FIG. 1 is a front, right and top perspective view of the skate of the present invention.
Figure 3:
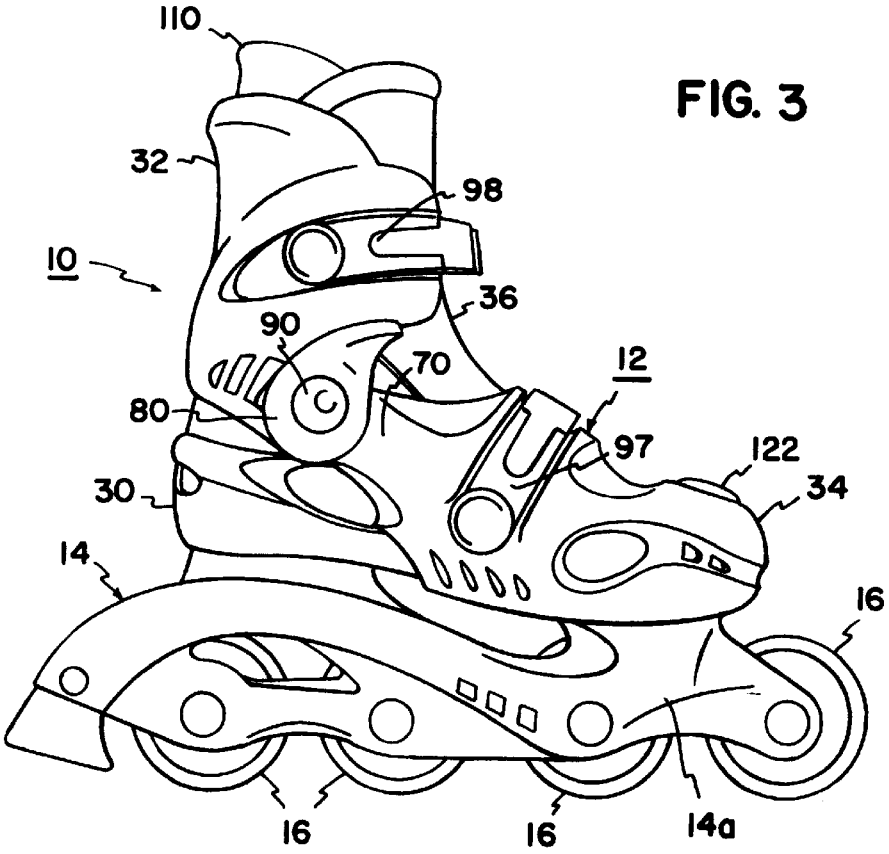
FIG. 3 is a right side elevation view of the skate of FIG. 1 shown adjusted to a minimum foot size adjustment.
Figure 4:
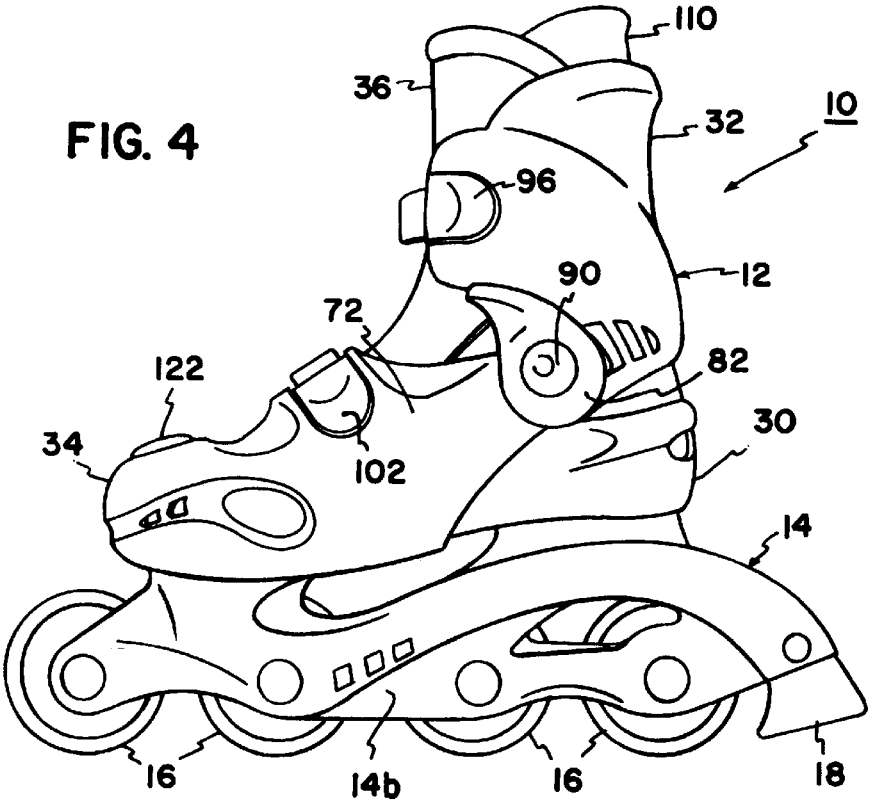
FIG. 4 is a left side elevation view of the skate of FIG. 1.
Figure 5:
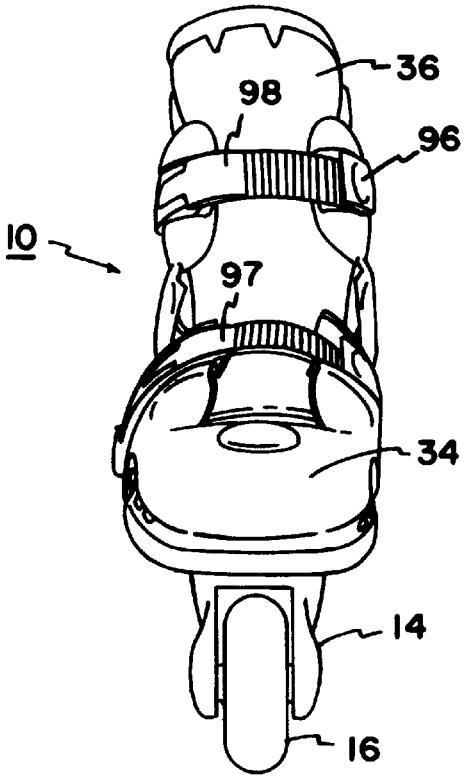
FIG. 5 is a front elevation view of the skate of FIG. 1.
Figure 6:
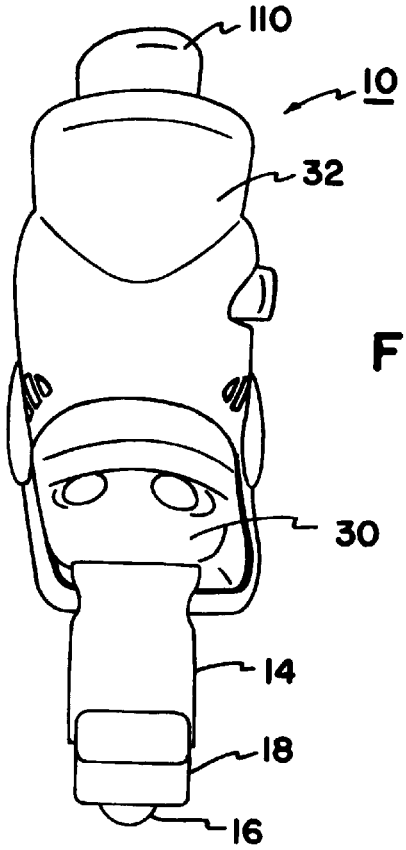
FIG. 6 is a rear elevation view of the skate of FIG. 1.
Figure 7:
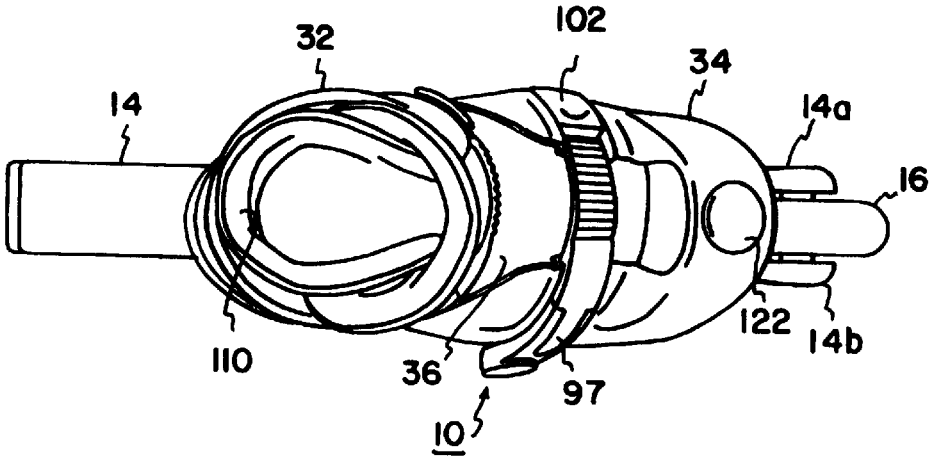
FIG. 7 is a top plan view of the skate of FIG. 1.
Figure 8:
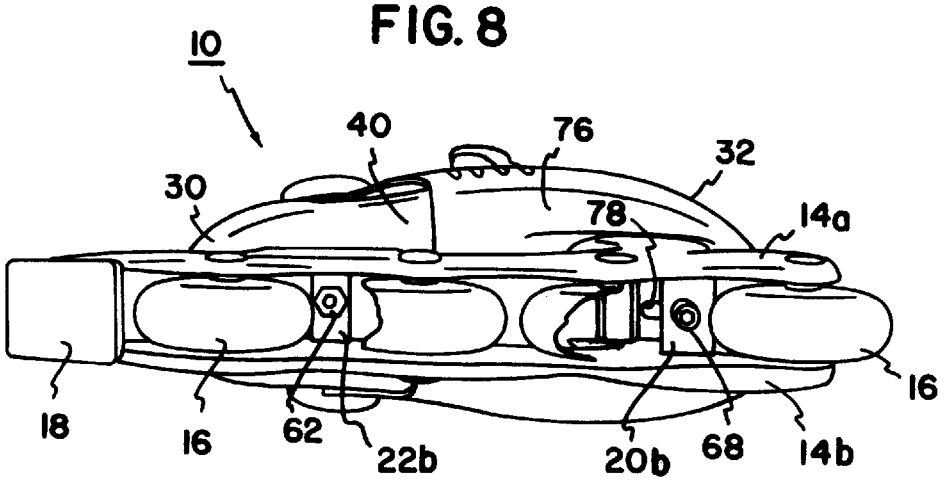
FIG. 8 is a bottom plan view of the skate of FIG. 1.

With reference now to the various drawing figures in which identical elements are numbered identically throughout, a description of the preferred embodiment of the present invention will now be provided.

In the various figures, an in-line skate 10 is illustrated having a skate boot 12 secured to a frame 14 and containing a liner 110. The frame 14 carries a plurality of wheels 16 which, in an in-line skate, are arranged in a line. Also, the frame carries a resilient brake pad 18 as is conventional.

Figure 11:
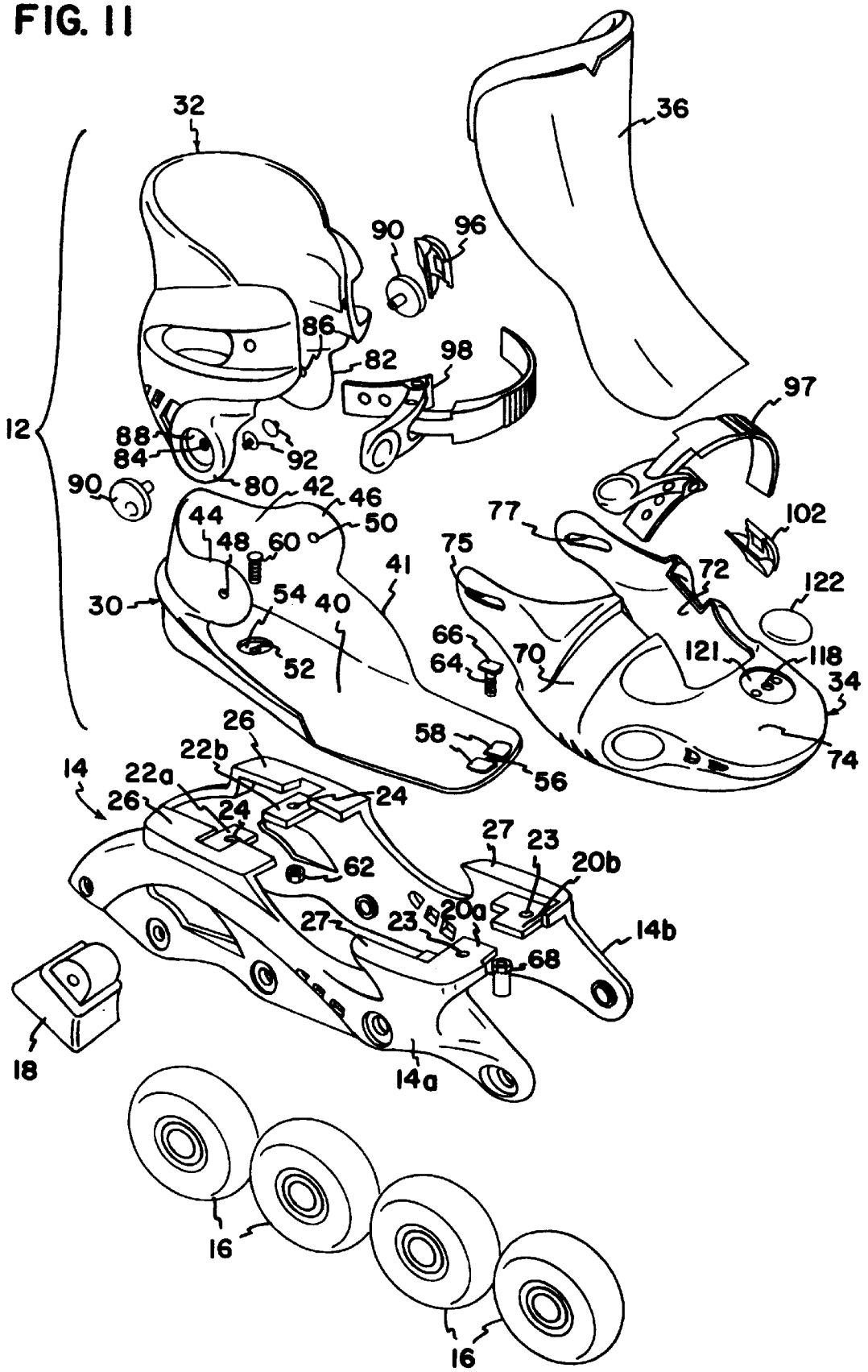
FIG. 11 is an exploded perspective view of the skate of FIG. 1 (without showing a liner)
Figure 12:
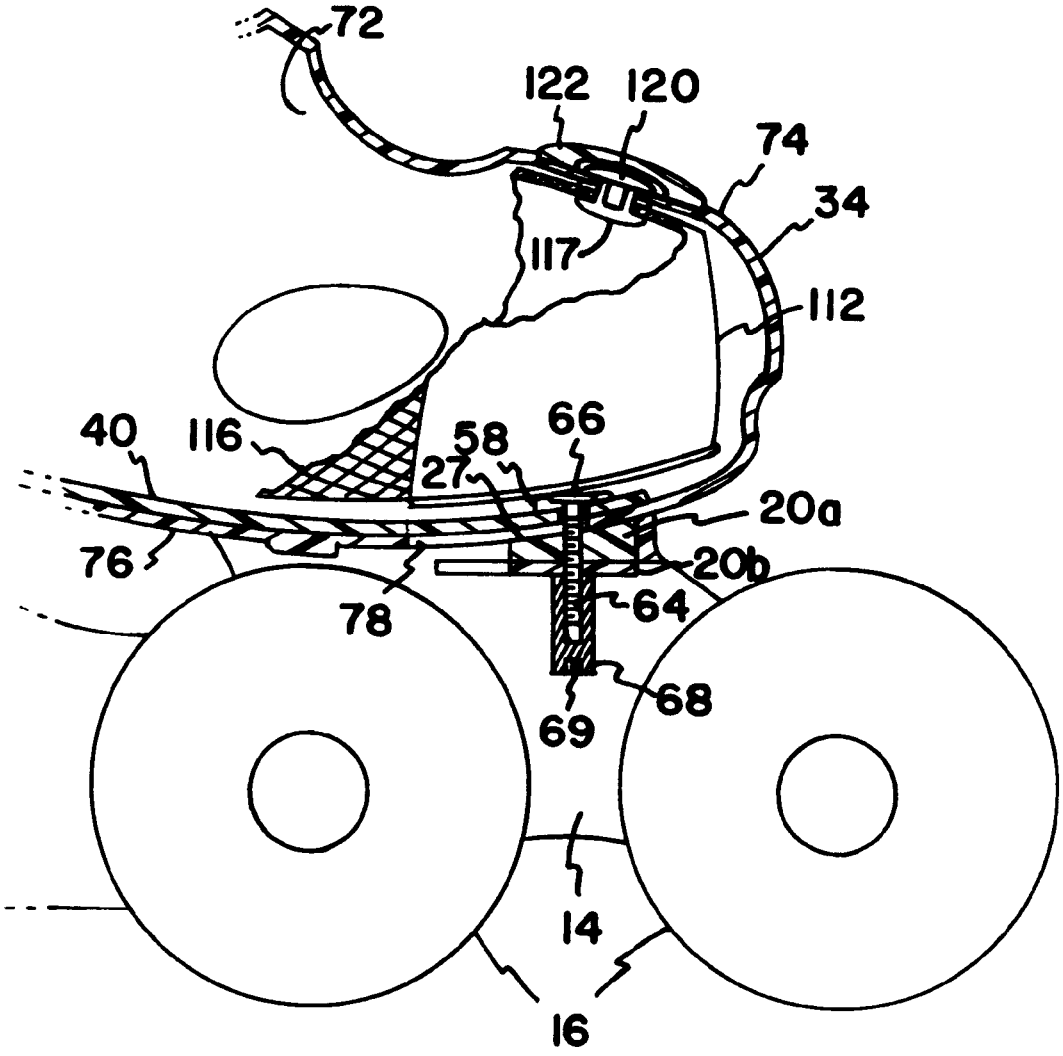
FIG. 12 is a side sectional view of a toe portion of the skate of FIG. 1.

Shown best in FIG. 11, the frame 14 includes two halves 14*a,* 14*b*. The frame halves 14*a,* 14*b* are slidably joined at offset and overlapping front tongues 20*a,* 20*b* (having holes 23) and rear tongues 22*a,* 22*b* (having holes 24). Holes 23 are in alignment when the halves 14*a,* 14*b* are joined. Holes 24 are similarly aligned when the halves 14*a,* 14*b* are joined. When the halves 14*a,* 14*b* are joined together, flat rear upper surfaces 26 of the halves 14*a,* 14*b* are in generally planar alignment to define a rear support platform. Upper surface 27 in the toe area of the frame defines a front support platform when the halves 14*a,* 14*b* are joined. As shown in FIG. 12, surfaces 27 are arcuate to mate with a base 76 to the portion 34 as will be described.

Referring back to FIG. 11, the boot 12 includes a heel portion 30, cuff 32, toe portion 34 and tongue 36. The heel portion 30 includes a sole 40 and a raised heel wall 42 having sidewalls 44, 46 each with holes 48, 50. The heel wall 42 surrounds the heel and lower ankle of the wearer with wall 46 being raised on the inside of the foot to provide additional support 41 for the arch of the user.

The sole 40 includes a hole 52 formed in a recess 54 at a heel end of sole 40. Similarly, at a toe end of the sole 40, a hole 56 is provided between two ramped surfaces 58. The base or sole 40 is sized to rest on the rear support platform 26 and the front support platform 27 with hole 52 aligned with holes 24 and with hole 56 aligned with holes 23. A bolt 60 is sized to be passed through hole 52 with the head end of the bolt received within the recess 54 and with the bolt 60 further passing through holes 24 and secured by a nut 62. Similarly, a bolt 64 having a head 66 sized to be received between ramped surfaces 58 is provided with the bolt 64 passing through hole 56 and aligned holes 23 and received within an elongated nut 68. As can be seen, since holes 52, 56 are approximately equal to the diameter of bolts 60, 64, once the heel portion 30 is secured to the frame 14, the heel portion 30 is restricted from movement relative to the frame 14.

The toe portion 34 includes a toe box having sidewalls 70, 72 and a top wall 74. Further, as shown in FIG. 12, toe portion 34 has a bottom wall 76. The bottom wall 76 is provided with an elongated slot 78 extending in a longitudinal dimension of the skate to pass the bolt 64. When assembled with the heel portion 30, the toe portion 34 is provided with the base 76 in underlying relation relative to the sole 40 of the heel portion 30. Further, the sidewalls 70, 72 are positioned in overlying relation to the exterior surfaces of the sidewalls 44, 46 of the heel portion 30. The sidewalls 70, 72 are provided with elongated slots 75, 77 aligned with holes 48, 50, respectively. With the construction thus described, upon loosening of elongated nut 68 (by use of an Allen wrench received in hole 69—see FIG. 12), the toe portion 34 may move along a line of travel which is generally parallel to the longitudinal dimension of the skate. The slots 75, 77 are aligned such that throughout the path of travel, the slots 75, 77 remain aligned with holes 48, 50.

The cuff 32 is provided to surround an upper ankle area of the wearer and surrounding the heel portion 42 as well as the rearward ends of the sidewall 70, 72. The cuff 32 has at its lower end pivot locations 80, 82 having holes 84, 86 aligned with holes 48, 50. A recessed area 88 surrounds hole 84. Although not shown, an identical recessed area surrounds hole 86.

Figure 13:
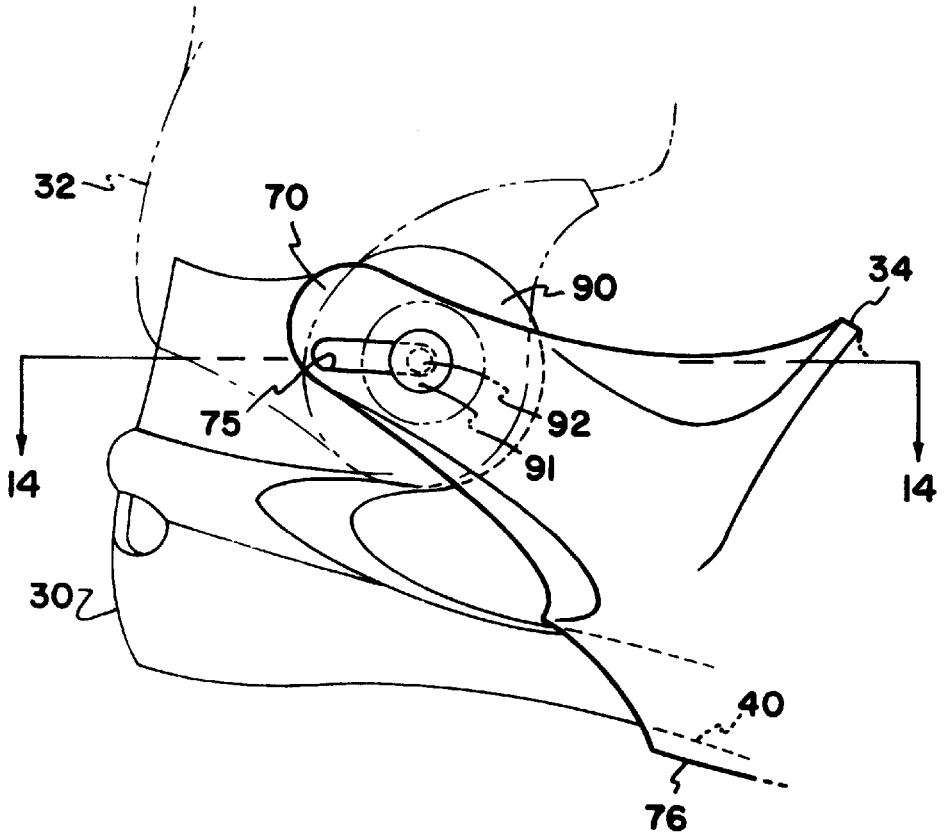
FIG. 13 is an enlarged view of a heel portion of the skate of FIG. 1 (with a cuff shown in phantom and without showing a frame)
Figure 14:
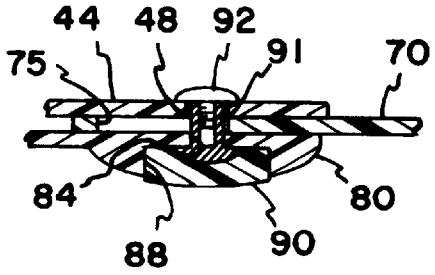
FIG. 14 is a view taken along line 14—14 of FIG. 13.

The attachment of the ends 80, 82 at holes 48, 50 is identical for both sides of the skate and a description with respect to end 80 will suffice as a description of end 82. The attachment is best shown in FIGS. 13 and 14 where a plug 90 (shown partially in phantom) is provided sized to be received within the recess 88 and with a sleeve 91 having an internal thread passed through hole 84, slot 75 and hole 48. A threaded bolt 92 is threaded into the interior of the sleeve 91. This method of attachment permits pivoting movement of the cuff 32 relative to the heel 30 and toe 34. Further, the connection permits relative sliding movement of the toe 34 relative to the heel portion 30 upon the loosening of nut 68.

A conventional buckle arrangement having a release fastener 96 secured to one side of cuff 32 and a tensioning buckle and strap 98 secured to the opposite side of cuff 32 is provided to permit the cuff 32 to be securely fastened to the leg of a wearer. Similarly, a like buckle arrangement having a tension strap and buckle 97 and a release fastener 102 are provided on opposite sides 70, 72 of the toe portion 34 to securely fasten the instep of the wearer's foot to the boot 12. Finally, a tongue 36 is provided as is conventional.

Figure 9:
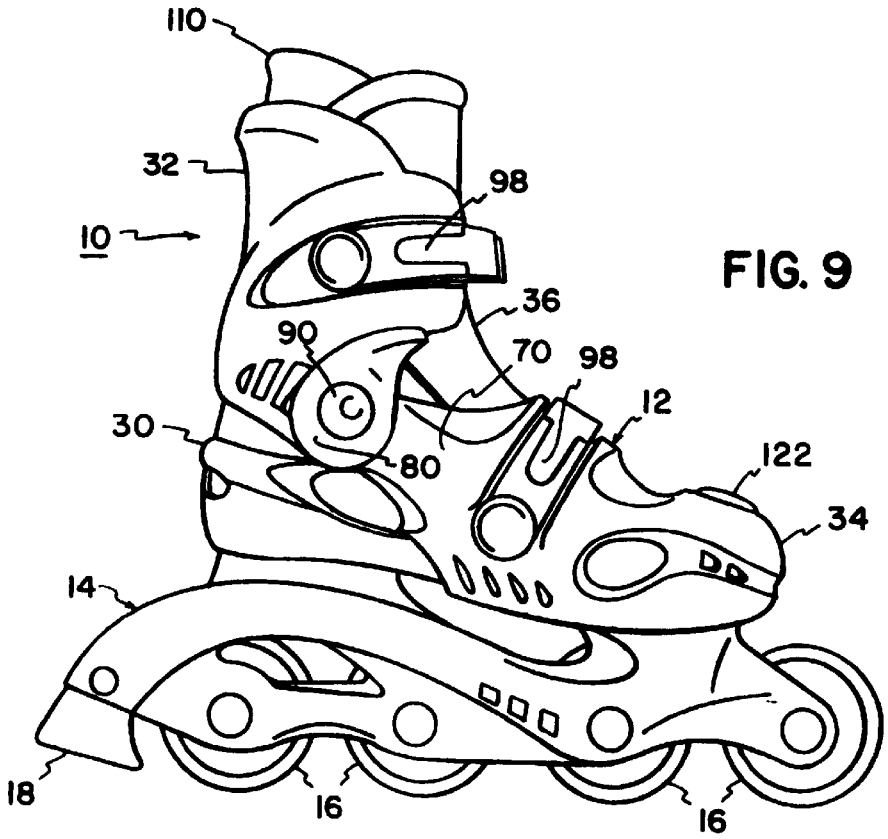
FIG. 9 is the view of FIG. 3 separately shown to compare with FIG. 10.
Figure 10:
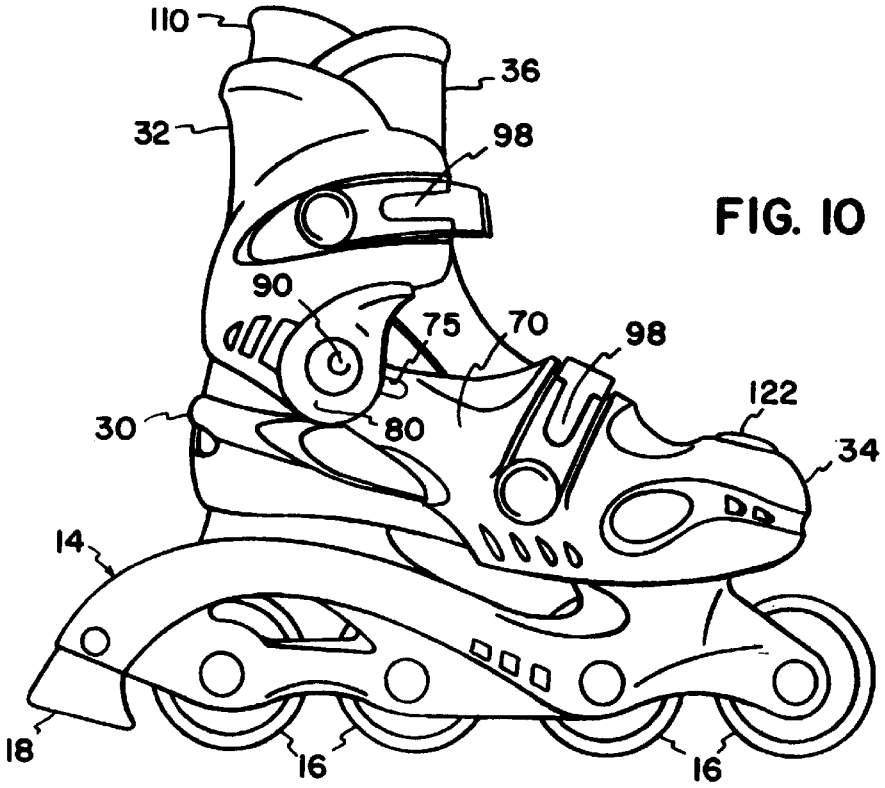
FIG. 10 is the view of FIG. 9 with the skate adjusted to a maximum foot size adjustment.

With the construction thus described, a wide variety of foot sizes can be accommodated by simply loosening nut 68 such that the toe portion 34 is moved relative to the heel portion 30. About four different foot sizes can be achieved by permitting a stroke of movement equal to about one inch. Accordingly, the slots 75, 77 will have a length of about one inch. Since a sliding adjustment is provided, unique adjustment is possible to accommodate unique foot sizes within a range between a minimum foot size (FIG. 9) and a maximum foot size (FIG. 10). Further, the foregoing design permits the use of a pivoting cuff 32 which has numerous advantages in the performance of in-line skating. Also, throughout the adjustment of the length, the positioning of the user's heel relative to the frame 14 and wheels 16 remains unchanged which presents a significant advantage in the performance of in-line skating since heel positioning is important to the performance of the skate.

The present invention also utilizes a novel construction of a liner 110 (FIG. 2) to accommodate increases in shoe size. The use of resilient liners in in-line skates is well known. The present liner 110 includes a generally inelastic toe portion 112 joined to the generally inelastic main body portion 114 by an expandable resilient section 116 positioned surrounding the instep area of the foot. Accordingly, the toe portion 112 may move relative to the main body portion 114. A lug 117 is provided on the toe portion 112. The lug 117 is secured to the upper wall 74 of the boot toe 34 by passing the lug 117 through a hole 118 formed in the upper surface 74 and securing the lug 117 in said position by a bolt or screw 120 (FIG. 12). The area surrounding the hole 118 is provided with a recess 121 to receive a decorative cap 122. Accordingly, as a user adjusts the size of the boot by expanding the toe portion 34 of the boot, the toe 112 of the skate liner 110 follows the toe 34 of the boot 12.

From the foregoing detailed description of the present invention, it has been shown how the objects of the invention have been attained in the preferred manner. However, modifications and equivalents of the disclosed concepts such as those which readily occur to one skilled in the art are intended to be included within the scope of the claims which are appended hereto.

What is claimed is:

1. An adjustable in-line skate comprising:

a rigid frame having a plurality of in-line skate wheels secured thereto;

a boot including a heel portion, a toe portion and a cuff portion positioned generally above the heel portion;

the heel portion being fixedly connected to the frame and the cuff portion pivotally connected to the heel portion;

the toe portion being slidable relative to the heel portion along a line of travel generally parallel to a longitudinal dimension of the skate; and a liner having a heel end, a toe end, a cuff and a tongue, the liner sized for the toe end to be received within the toe portion, the heel end to be received within the heel portion, and the cuff to be received within the cuff portion of the boot, the liner including a generally inelastic heel region and an extendible region positioned between a toe region of the liner and the tongue, the extendible region being configured to allow the toe end to be moved longitudinally relative to the tongue and heel end such that the liner can accommodate feet of different sizes.

2. The in-line skate of claim 1, wherein the extendable region is elastic.

3. An adjustable in-line skate comprising:

a frame having a plurality of in-line skate wheels secured thereto;

a boot having a heel portion and a toe portion;

the heel portion being fixed relative to the frame;

the toe portion being moveable relative to the frame along a longitudinal line of travel generally parallel to a longitudinal dimension of the skate;

a cuff portion positioned generally above the heel portion; and first and second extension structures, each extension structure extending from the toe portion to the cuff, each extension structure being slidably connected to the cuff portion so as to allow each extension structure to slide relative to the cuff portion along the longitudinal line of travel, wherein when the toe portion is moved relative to the frame along the longitudinal line of travel, each extension structure slides relative to the cuff portion.

4. The in-line skate of claim 3, wherein the extension structures include lateral and medial extension members slidably connected, respectively, to lateral and medial sides of the cuff portion.

5. The in-line skate of claim 4, wherein the cuff portion is pivotally connected to the heel portion by cuff fasteners.

6. The in-line skate of claim 5, wherein the lateral and medial extension members are slidably connected to the cuff portion by the cuff fasteners.

7. The in-line skate of claim 6, wherein the lateral and medial extension members define slots elongated along the longitudinal line of travel, and the cuff fasteners extend through the slots.

8. The in-line skate of claim 3, wherein the extension structure is integrally formed as a single piece with the toe portion.

* * * * *